US010852105B1

(12) United States Patent
Xiaowen et al.

(10) Patent No.: US 10,852,105 B1
(45) Date of Patent: Dec. 1, 2020

(54) MACHINE FOR DISCHARGING A WATERFALL OF LOW TEMPERATURE SPARKS

(71) Applicants: Zhou Xiaowen, Liuyang Hunan (CN); Steve Bruce Freedman, Lake Worth, FL (US)

(72) Inventors: Zhou Xiaowen, Liuyang Hunan (CN); Steve Bruce Freedman, Lake Worth, FL (US)

( * ) Notice: Subject to any disclaimer, the term of this patent is extended or adjusted under 35 U.S.C. 154(b) by 0 days.

(21) Appl. No.: 16/198,974

(22) Filed: Nov. 23, 2018

Related U.S. Application Data

(60) Provisional application No. 62/590,186, filed on Nov. 22, 2017.

(51) Int. Cl.
*F42B 4/18* (2006.01)
*A63J 5/02* (2006.01)

(52) U.S. Cl.
CPC .. *F42B 4/18* (2013.01); *A63J 5/02* (2013.01)

(58) Field of Classification Search
CPC ..... F42B 4/18; F42B 4/20; F42B 4/00; A63J 5/02; A63J 5/00
USPC ..... 102/355
See application file for complete search history.

(56) References Cited

U.S. PATENT DOCUMENTS

| | | | | |
|---|---|---|---|---|
| 2004/0113300 | A1* | 6/2004 | Jurgens | B01J 2/04 264/9 |
| 2011/0033805 | A1* | 2/2011 | Multamaki | F42B 4/00 431/8 |
| 2018/0238664 | A1 | 8/2018 | Chen et al. | |

FOREIGN PATENT DOCUMENTS

| | | | | |
|---|---|---|---|---|
| CN | 2872289 | Y | | 2/2007 |
| CN | 205102695 | | * | 3/2016 |
| CN | 105854317 | A | | 8/2016 |
| CN | 205784897 | U | | 12/2016 |
| CN | 206410605 | | * | 8/2017 |
| WO | 2017075890 | A1 | | 5/2017 |
| WO | 2017075892 | A1 | | 5/2017 |
| WO | 2017206525 | A1 | | 12/2017 |
| WO | 2018133396 | A1 | | 7/2018 |
| WO | 2019028956 | A1 | | 2/2019 |
| WO | 2019137198 | A1 | | 7/2019 |
| WO | 2019148595 | A1 | | 8/2019 |

OTHER PUBLICATIONS

Office Action, U.S. Appl. No. 16/178,246, dated Jan. 27, 2020.

* cited by examiner

*Primary Examiner* — Joshua E Freeman

(74) *Attorney, Agent, or Firm* — Saul Ewing Arnstein & Lehr LLP; Brian R. Landry

(57) ABSTRACT

A cold spark waterfall machine, which comprises an accelerating unit, a heating unit, a power unit, and a storage unit. The storage unit stores a cold fireworks raw material for discharging. The power unit is connected to the storage unit wherein the storage unit is connected with the heating unit, and the power unit transmits the cold fireworks raw material in the storage unit to the heating unit. The heating unit activates the cold fireworks raw material and sends the cold fireworks raw material to the acceleration unit. The acceleration unit causes the activated material to accelerate in a downward eruption, thus forming a waterfall of low temperature sparks.

18 Claims, 8 Drawing Sheets

MACHINE FOR DISCHARGING A WATERFALL OF LOW TEMPERATURE SPARKS

CROSS-REFERENCE TO RELATED APPLICATION

This application claims the benefit of U.S. Provisional Patent Application Ser. No. 62/590,186 filed Nov. 22, 2017, which is incorporated herein in its entirety.

FIELD OF THE INVENTION

The present invention relates generally to the field of fireworks and stage fixtures, and in particular to equipment for cold fireworks.

BACKGROUND OF THE INVENTION

Fireworks have been a tradition through time, often used in stage performances, celebrations, and venues. As the fireworks are normally discharged through gunpowder, the resulting explosions release intense smoke and an irritating smell. The smoke and byproducts can become a pollutant in the environment and create safety issues. In recent years, these safety issues have become more apparent resulting in more strict safety guidelines to be followed when using fireworks in performances. Therefore the urgent need to increase firework safety and non gunpowder fireworks equipment has become inevitable. This is where the vision for cold eruption fireworks equipment has become a trend.

Although currently exiting systems able to achieve the discharge of cold fireworks, these implementations are overly complex structures, and especially the transmission is too complex to achieve high efficiency in cost. Also, these instruments usually have a larger physical volume which makes transportation and installation less convenient. Further, known systems are only usable in an upright position, and cannot achieve a downward cold spark effect that is needed in many venues and various needs of the entertainment industry.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a cold spark waterfall machine, which comprises an accelerating unit, a heating unit, a power unit and a storage unit. The storage unit stores a cold fireworks raw material for discharging. The power unit is connected to the storage unit wherein the storage unit is connected with the heating unit, and the power unit transmits the cold fireworks raw material in the storage unit to the heating unit. The heating unit activates the cold fireworks raw material and sends the cold fireworks raw material to the acceleration unit. The acceleration unit causes the activated material to accelerate in a downward eruption, thus forming the effect of cold fireworks discharge.

These and other objects, features, and advantages of the present invention will become more readily apparent from the attached drawings and the detailed description of the preferred embodiments, which follow.

In view of the above-mentioned problems, it is an object of the present invention to provide a cold fireworks discharge waterfall machine which is simple in construction and simple to use. Using simple internal components to initialize the discharge of cold fireworks is an object. This invention would also be easy to utilize, have a smaller physical size, and be more convenient for transportation and installation. It is another object of the present invention to provide a stage spark waterfall machine which can be suspended and discharged by a structural configuration, which is capable of satisfying the discharge requirements of various performance venues and stages. In order to achieve the above object, the technical solution of the present invention is: A cold spark waterfall machine comprised by an accelerating unit, a heating unit, a power unit, and a storage unit. The storage unit stores the cold fireworks raw material for discharge. The power unit is connected to the storage unit and the material storage unit is connected to the heating unit. The power unit transmits the cold fireworks raw material in the storage unit to the heating unit. The heating unit activates the cold fireworks raw material and supplies the cold fireworks material to the acceleration unit, and accelerates the material downward to create an eruption in the downward position, and thus the formation of cold fireworks discharge effect downwardly to appear as a waterfall of sparks.

Further, since the present invention is to discharge the cold fireworks downwards, it must be suspended for use. This requires the center to be stabilized to reach a state of equilibrium so the device isn't tilted during discharge, in order to achieve stable discharge downwardly. Based on this, the material storage unit is centered, due to the need to reload cold fireworks raw materials, and the weight needing to stay balanced throughout discharge. To achieve this, as described the storage unit is arranged at the central position, and the power unit, the heating unit and the acceleration unit are arranged on both sides of the storage unit, accordingly, to achieve a centrally located center or gravity.

Further, in order to ensure that the cold fireworks raw material is substantially discharged, the power unit includes a motor, and the storage unit includes a storage silo containing a cold fireworks raw material such as a metal powder (e.g. a composite titanium powder or other metal particles). The power unit has a pushing mechanism that extends into a hopper and is capable of projecting a portion of material from the silo to eject the cold fireworks material in the storage silo. The heating unit is composed of the heating tube and the heating coil. Further, the pushing mechanism is connected to the output shaft of the motor and is arranged horizontally, and the pushing mechanism is provided at the bottom of the hopper so as to be able to push the cold fireworks raw material in succession to the silo.

Further, the storage bin is provided with a pushing mechanism mounting port corresponding to the horizontal position of the pushing mechanism, and the pushing mechanism mounting port and the pushing mechanism are sealed to avoid leakage of the cold fireworks raw material.

Further, the storage bin has a discharge port at the other end in the horizontal direction of the pushing mechanism, thereby facilitating the pushing of the cold fireworks material into the heating unit, which is connected to the heating unit. The pushing mechanism may be a screw or worm drive.

Further, the outer surface of the lead screw has a threaded structure to facilitate the promotion of the cold fireworks raw material. The connecting portion of the storage unit and the heating unit is provided with a funnel which is connected to the heating pipe so as to collect the cold fireworks raw material so that the cold fireworks material can be effectively heated.

Further, the heating tube of the heating unit is arranged vertically so as to allow the cold fireworks raw material to fall in the device. For example, the heating tube may be vertical, to allow the raw material to fall in line from an edge of the storage unit, through the hating tube, and out a discharge end of the accelerating unit. Therefore, gravity may help the raw material to flow through the heating tube. The accelerating unit includes a fan, and an air chamber connected to the heating chamber. The lower part of the air chamber is provided with a plurality of injection holes. The air chamber is connected with the heating pipe, and the cold fireworks raw material that is activated by the heating tube passes through the air chamber. The wind blown out of the fan accelerates the material, and then sprays from the nozzle downwardly. This forms the effect of cold fireworks discharge. Further, the fan has a plurality of air ducts connected to the air chamber through a plurality of air ducts, respectively, and the ducts are arranged perpendicularly to the air chamber so as to form a good acceleration action.

Further, the air chamber is a ring-like structure so as to provide a duct, while the annular chamber is advantageous for the air to flow in the air chamber and to promote the heating of the cold fireworks material. Further, a nozzle hole is provided on the lower surface of the air chamber and can be designed in accordance with the form of spark eruption to reflect the specific effect of the cold fireworks eruption. The accelerating unit includes an air chamber, a duct and a fan, wherein an upper portion of the air chamber has an engaging hole. An air duct is provided at an upper portion of the air chamber, a plurality of orifices are provided on the lower bottom surface of the air chamber; to spray or accelerate the air and cause the spark to accelerate.

Further, the air chamber is of an annular structure, and the upper periphery of the air chamber is provided with 2 to 6 ducts. The ducts are arranged horizontally and the ducts are connected to the fans for blowing, thereby causing an accelerating effect. The size of the inner diameter of the heating tube is the same as that of the connected tube so that the heating tube can be inserted into an engagement hole so as to be fixed. The invention has the advantages of simple structure, easy utilization, small volume and good handling performance. This is achieved by combining the functions of the cold fireworks and the like by combining the components of the simple acceleration unit, the storage unit and the heating unit together. The above results in a simple structure for easy transportation and installation. The use of the process will not take up too much space, and is efficient to produce.

Further disclosed is a cold spark waterfall machine characterized in that the waterfall machine comprises an accelerating unit, an activation (heating) unit, a power unit and a storage unit. The storage unit stores a cold fireworks raw material for discharge. The power unit is connected to the storage unit and also is connected with the heating unit. The power unit transmits the cold fireworks raw material in the storage unit to the heating unit, the heating unit activates the cold fireworks raw material then sends it to the acceleration unit. The acceleration unit accelerates the flow of cold fireworks material and directs the material to accelerate the eruption down, thus forming the effect of a cold spark waterfall.

In another aspect, said material storage unit is provided at a central position such that the power unit, the heating unit and the acceleration unit are located on both sides of the storage unit.

In another aspect, said power unit is implemented by a motor. The storage unit is implemented by a silo, said storage unit containing cold fireworks raw material. The power unit has a pushing mechanism which extends into the hopper to push out the cold fireworks raw material in the storage bin.

The heating unit is implemented by the activation tube and the heating coil.

In another aspect, a pushing mechanism is connected to the output shaft of the motor and is arranged horizontally and said pushing mechanism is provided at the bottom of the silo.

In another aspect, said storage bin is provided with a pushing mechanism mounting port corresponding to the horizontal position of the pushing mechanism and said pushing mechanism mounting port is sealed with the pushing mechanism. The storage bin has a discharge port at the other end in the horizontal direction of the pushing mechanism so as to push the pushing mechanism into the heating unit, and the discharge port is connected to the heating unit.

In another aspect, said pushing mechanism is a screw.

In another aspect, the connection portion of the heating unit is provided with a funnel which is connected to the heating pipe so as to collect the cold fireworks raw material and enable the cold fireworks raw material to be effectively activated.

In another aspect, said accelerating unit is composed of a fan, an air chamber connected to the air chamber and a lower portion of said air chamber being provided with a plurality of orifices. The air chamber is connected to the heating tube, the heating tube activates the cold fireworks raw materials through the air chamber, and the wind blows out of the fan to accelerate the formation of a cold fireworks discharge effect.

In another aspect, said accelerating unit is comprised of an air chamber, a duct and a fan. An upper portion of the air chamber has an engagement hole, and the upper periphery of the air chamber is connected to the lower part of the air chamber. The lower part of the chamber is equipped with a plurality of nozzles to eject the airflow and accelerate the activated material.

In another aspect, said air chamber is of an annular structure and the upper periphery of the chamber is provided with 2-6 ducts, the ducts being arranged horizontally and the ducts connected to the fan. The inner diameter of the engaging hole coincides with the outer diameter of the heating tube so that the heating tube can be inserted into the engaging hole so as to be fixed.

As another example, disclosed is a special effects device for ejecting sparks, the device comprising: an eruption unit (i.e. acceleration unit), an activation unit, a power unit, a storage unit configured to store a source material, wherein the power unit is connected to the storage unit and the storage unit is connected to the activation unit, wherein the power unit is configured to transmit the source material from the storage unit to the activation unit, wherein the activation unit is configured to excite the source material to an excited state and send excited source material to the eruption unit, wherein the eruption unit is configured to eject the excited source material via pressure applied by the power unit, wherein the source material is configured to adopt the appearance of a spark by being subjected to airflow while the source material is in an excited state.

In another aspect, the source material includes a powdered metal.

In another aspect, exciting the source material causes the source material to be heated inside the device.

In another aspect, exciting the source material causes the source material to be heated to a glowing state inside the device.

In another aspect, the power unit is configured to concurrently transmit source material from the storage unit to the activation unit and apply pressure to the eruption unit to eject excited source material received from the activation unit.

In another aspect, the power unit is connected to a lower part of the storage unit through a duct to such that the source material smoothly enters the activation unit.

In another aspect, a conveying pipe is connected to the storage unit, and the conveying pipe is connected to the activation unit such that the source material is discharged through a side of the storage unit.

In another aspect, the activation unit includes a heating coil and a heating pipe, and the heating pipe is vertically arranged to be connected to the conveying pipe, and an outer wall of the conveying pipe includes a discharge port such that pneumatic pressure in the conveying pipe is released such that the source material has sufficient time to be excited in the activation unit.

In another aspect, the activation unit is connected to an adjusting mechanism, and the adjusting mechanism is connected to the eruption unit, such that the source material that is excited by the activation unit is sent to the eruption unit by a regulating mechanism such that the eruption unit can eject excited source material, wherein the adjusting mechanism includes a regulating pipe, where a middle of the regulating pipe is connected to an upper part of an activation tube of the activation unit, and such that a first end of the regulating pipe is connected to the eruption unit, and a second end of the regulating pipe is open.

In another aspect, the eruption unit is a vertically arranged pipe having at least an upper segment and a lower segment, each segment having a different inner diameter and an inner diameter of the lower section being smaller than an inner diameter of the upper section.

In another aspect, the regulating pipe is connected to an upper portion of the eruption unit, and an inner diameter of the regulating pipe is larger than an inner diameter of the upper portion of the eruption unit.

In another aspect, a diverging mechanism is included having two tuyere ports, a first tuyere port being connected to the duct that connects the power unit to the storage unit, and a second tuyere port connected to an upper section of an eruption pipe of the eruption unit.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
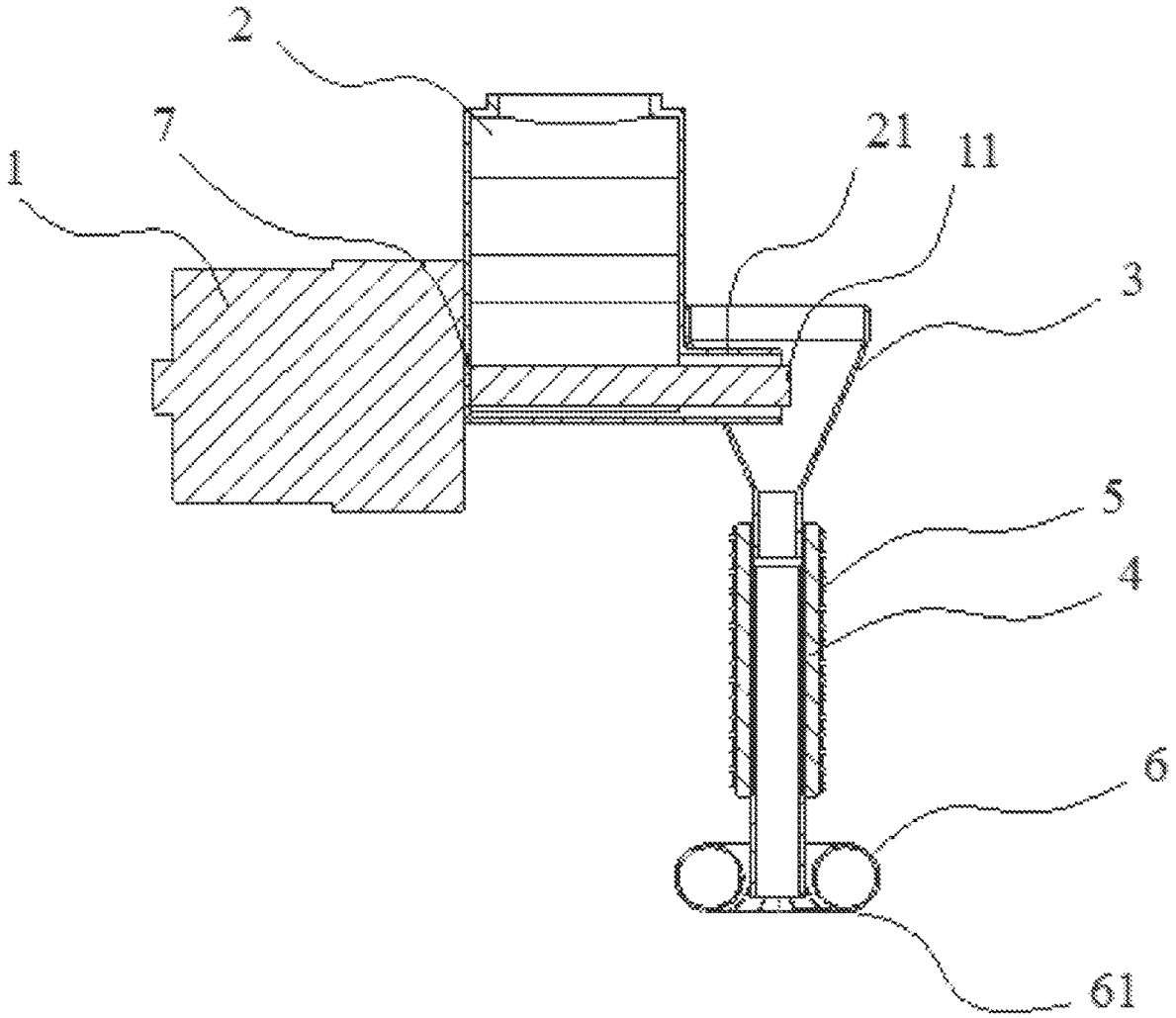
FIG. 1 is a cross sectional schematic view of the structure of the present invention.
Figure 2:
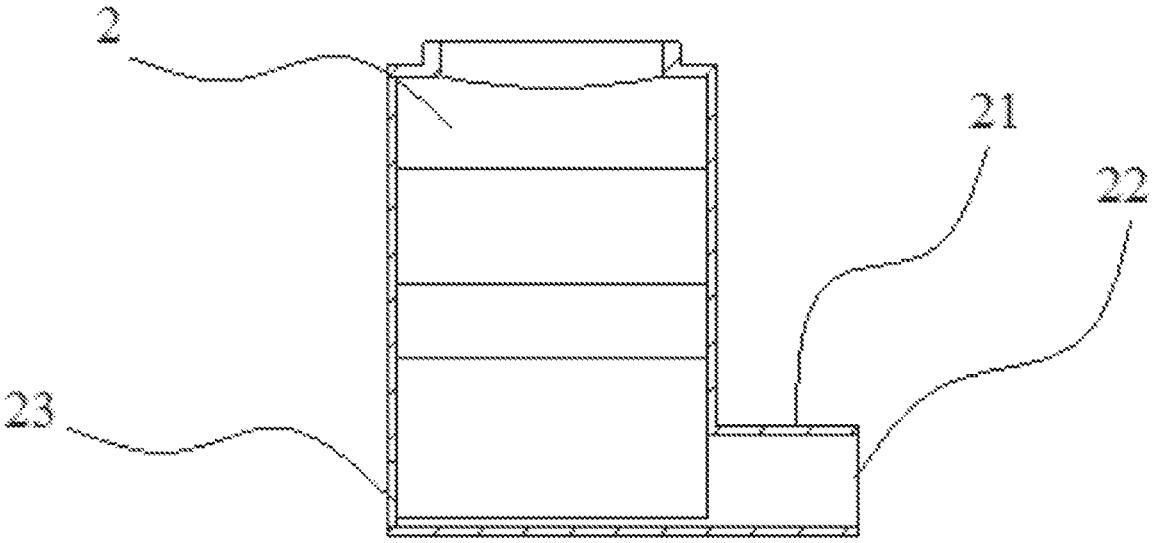
FIG. 2 is a cross-sectional schematic structural view of a storage unit realized by the present invention.
Figure 3:
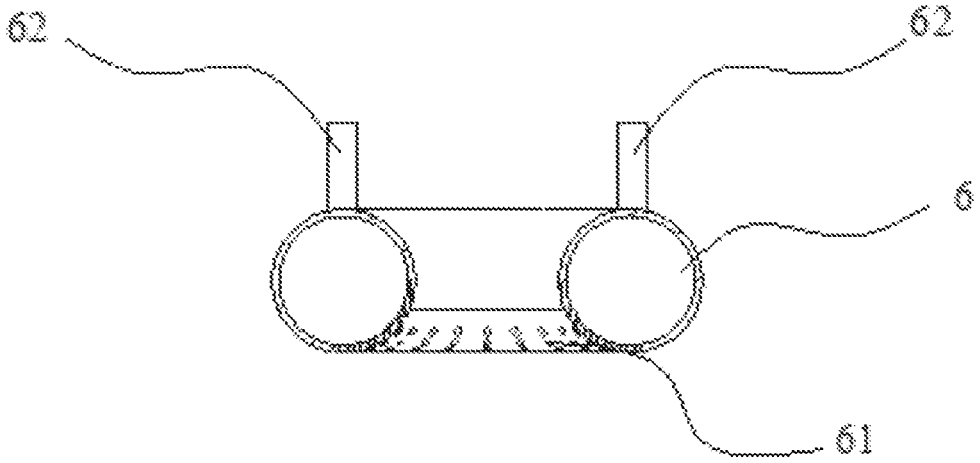
FIG. 3 is cross-sectional a schematic structural view of an accelerating unit realized by the present invention.
Figure 4:
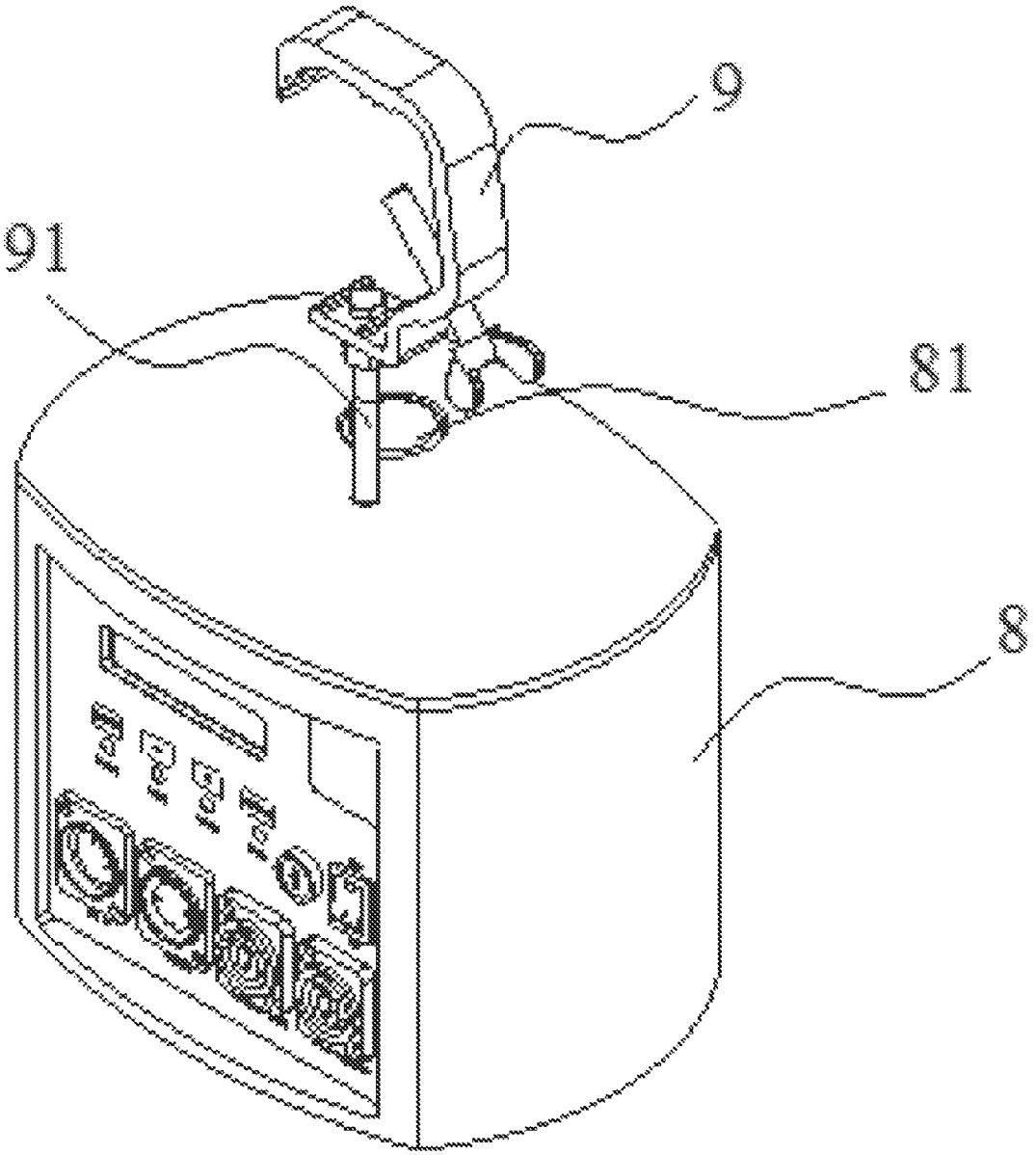
FIG. 4 is a perspective view of a specific implementation of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention will now be described in further detail with reference to the accompanying drawings. The accompanying drawings, in which the objects are shown, will help highlight the advantages of the present invention and will become more apparent from the following description. It is to be understood that the specific embodiments described herein are merely illustrative of the invention and are not intended to limit the invention.

It is to be understood that a cold fireworks discharge effect may be a visual effect (e.g. special effect) caused by a hot material such as heated powdered metal, or molten or glowing hot metal, being subjected to airflow or oxygen, which causes a visual artifact that appears to be a spark (i.e. cold spark). A cold spark may be relatively cool to the touch such that the spark does not burn one's hand. The cold spark may be emitted lower than body temperature, as a non-limiting example. The cold spark is a result of an ejection of pre-heated material, where the material is heated before ejection, and may even be in the form of a spark within an ejection tube before being emitted from the ejection tube.

It is to be understood that the cold spark discharge is not executed by combusting a fuel such as gunpowder or other traditional firework materials, and instead is executed by heating the cold firework material to an appropriate degree (e.g. 500-600 degrees Celsius) such that heated cold firework material is excited (i.e. activated) in the heating unit, and such that the heated cold firework material may be subsequently ejected. When the heated cold firework material is ejected, airflow causes the heated cold firework material to emit, or cause the appearance of, sparks (cold sparks) through rapid oxidation. The material may be any appropriate material, such as titanium powder, zinc powder, zirconium powder, or a combination thereof. The heated cold firework material undergoes rapid oxidation when exposed to airflow (e.g. oxygen). This may be referred to as a "pyrosimulation" effect which means no flames are actually created, and the appearance of traditional fire or sparks is merely simulated.

Further, it is to be understood that the term "spark" may refer to a small glowing particle, or in some examples a visual effect or appearance of a spark.

In some instances, the emitted cold sparks (cold spark effect) may be cool enough for a user to touch without burning their hand. Such cold spark effect may be generally referred to as a cold spark special effect, a touch-safe spark special effect, a non-pyrotechnic spark special effect, or a pyrosimulation special effect, without departing from the spirit and scope of this disclosure.

The cold spark material may contain no chemical binders as found in typical fireworks. The material may be heated to a glowing or molten state in the device, which may be referred to an "activated" or "excited" state. In a cross-referenced priority document to this disclosure, such a state is referred to as "ignited" but it is to be understood that the material is not ignited as defined in plain English, and is instead merely heated. Further, the term "combustion" may have been used in a cross-referenced priority document to this disclosure, but such term is not to be understood in its plain English meaning, and is instead to be understood as "heating", "activating", or "exciting". Such terms should be understood in the context of "cold fireworks" or "cold pyrotechnics" as showcased in the industry and field of fireworks, pyrotechnics, and/or special effects.

It is to be understood that the term "cold fireworks" may refer to non-gunpowder pyrotechnics that do not use gunpowder or other explosives, and instead provides sparks by way of heating a material and exposing the material to atmosphere to cause the material to spark. Any appropriate phenomenon may cause the cold spark effect. But the sparks are not typical sparks seen from traditional combustive fireworks that would burn a user's hand. The material may be a metal powder having an appropriate particle size to provide the cold spark effect. The particles may be super heated and super cooled to cause the cold spark effect. For example, in the heating unit (ignition unit) the particles may be heated to approximately 585 degrees Celsius, or above 565 degrees Celsius, and may be cooled to room temperature rapidly, causing the cold spark effect when the material is exposed to air. Rapid oxidation may cause this effect. And a bi-product may be a respective metal-oxide (e.g. titanium oxide, zinc oxide). One or a combination of air flow, cooling, and particle size may be appropriate factors for causing the cold spark effect. The material may be approximately 95% titanium and 5% zirconium.

It is to be understood that the term "cold fireworks" is to be interpreted in the scope of the industry, and is not meant to define an exact temperature. For example, a cold firework material is not combusted in the heating chamber, and is merely heated, and does not contain chemical binders. "Cold fireworks" may relate to "low-temperature" fireworks, where emitted special effects material is safe for indoor use.

Activating (heating) the cold firework material may include heating the material to at least 560 degrees Celsius. But it is to be understood that temperatures stated herein may range plus or minus 20 degrees Celsius and all degrees in-between such range. The range may also vary such that an ejected spark is not above 120 degrees Fahrenheit. The material may be heated such that it is glowing or molten in the device. The heated material rapidly cools during transport through the device (due to a specially selected thermal mass, heat capacity, and/or conductivity) before being ejected, and may cool to a degree in the range of room temperature to a few or more degrees above room temperature (e.g. 60-100 degrees Fahrenheit). Sometimes the ejected material (as sparks) may reach about 115 degrees Fahrenheit near a spout of the device (e.g. top of ejection tube). The granularity of the material may be a powder being having a US mesh value of 80-100 as a non-limiting example, having a consistency of course ground culinary pepper.

As shown in FIG. 1, the waterfall machine includes an accelerating unit, a heating unit, a power unit and a storage unit. The storage unit stores a cold fireworks material and the power unit is connected with the storage unit. The storage unit is connected with the heating unit, the power unit transmits the cold fireworks raw material in the storage unit to the heating unit. The heating unit activates the cold fireworks raw material, and is sent to the accelerating unit. The accelerating unit causes the activated material to accelerate in a downward eruption, thus forming the effect of cold fireworks discharge.

The power unit includes a motor (1), and the storage unit includes a silo (2), which is usually a funnel type structure containing a cold fireworks raw material such as a metal powder. (such as a composite titanium powder or other metal particles). The motor (1) is connected to a pushing mechanism (11) which extends into the hopper (2) and is capable of projecting a small portion from the silo (2) to push out the cold fireworks material in the hopper (2). The heating unit includes heating tubes and heating coils. Since the present invention is intended to be discharged from the cold fireworks machine in a downward direction, it is necessary to be suspended for use, which requires a stable center and a balanced state in order to achieve stable discharge. Based on this, the material storage unit is centered, due to the need to reload cold fireworks raw materials, and the weight needing to stay balanced throughout discharge. The storage silo (2) is provided at the central position, and the motor, the heating pipe (4) and the acceleration unit (including the fan and the air chamber (6)) are provided on both sides of the silo (2) to achieve a balanced and centralized center or gravity.

The push mechanism is typically a screw (11) for easy connection to the motor (1) and for ease of control. Normally, the lead screw (11) is connected to the output shaft of the motor and is arranged horizontally and the lead screw (11) is provided at the bottom of the silo (2) so as to be able to push the cold fireworks raw material in succession to the silo.

A screw mounting port (23) is provided in the horizontal position of the hopper (2) corresponding to the screw (11), and the screw mounting port (23) and the lead screw (11) are sealed by the sealing ring (7), in order to avoid a cold fireworks raw materials leak.

At the same time, the silo (2) has a discharge end corresponding to the other end of the screw (11) in the horizontal direction, and the discharge end (21) extends into the hopper (3), and the outside of the discharge end (21) has a supply port (22) through which the cold fireworks material is pushed into the funnel (3) to facilitate accurate push of the cold fireworks material into the heating unit.

The screw (11) may be a smooth surface structure and push the cold fireworks material into the funnel (3) only by the movement in the horizontal direction, or it may be designed so that the outer surface has a protruding male thread structure so that the material can be moved by the rotation of the screw (11). The screw does not translate, and instead the threads may cause the material to be pushed like an auger. It is possible to push the cold fireworks material into the funnel (3). A funnel (3) is connected to the heating pipe (5) at a portion where the hopper (2) is connected to the heating pipe (5), and the funnel (3) is connected to the heating pipe (4) so as to collect the cold fireworks raw material and enable the cold fireworks material to be effectively heated. The outer wall of the heating tube (4) is wound with a heating coil (5), and the heating pipe (4) is vertically arranged so as to drop the cold fireworks raw material.

The storage tank (2) stores the cold fireworks material for discharge, and the motor (1) connects the screw (11) to the lower part of the silo (2) which transfers the cold fireworks material in the hopper (2) to the funnel (3) and then falls vertically to the heating tube (4), then heats the cold fireworks raw material under the action of the heating coil (5) to form a spark in which the spark falls vertically from the heating pipe (4) and is accelerated by the acceleration unit during the falling process to form a cold spark effect.

The accelerating unit may include a fan (not shown) and an air chamber (6), the fan being connected to the air chamber (6) through a duct (62), the lower portion of the air chamber (6). There is provided a plurality of orifices (61) which are annular structures which are arranged around the heating tube (4) to heat the cold fireworks raw material to form a spark, the spark falling through via free fall, and/or via blown wind blown through the duct (61) into the air Chamber (6), and then through the nozzle (61) as jet air flow, the air flow being configured to accelerate the spark to form the effect of cold fireworks discharge, which can make the spark to discharge 2-5 M discharge effect.

In order to effectively carry out the discharge of sparks, the blower has a plurality of air ducts (62) connected to the air chamber (6) through a plurality of air ducts (62), respectively, and the air ducts (62) are arranged perpendicularly to the air chamber so as to form a good acceleration action.

Normally, the duct (62) has 2 to 6, evenly disposed on the upper surface of the air chamber (6), while the annular air chamber (6) facilitates the flow of the gas in the air chamber, enabling the formation of sufficient airflow to increase the acceleration effect on the spark.

A nozzle hole (61) is provided on the lower surface of the air chamber (6) and can be designed specifically to eject cold fireworks in a desired way, in various ejection patterns and shapes. Therefore the nozzle hole may be shaped in various ways to eject the cold firework sparks in various ways, accordingly. It is a specific application of the present invention to provide the above-mentioned cold spark waterfall dispenser in a casing (8) having an opening (81) at the top thereof. The hole (81) is aligned with the top opening of the storage bin to serve the cold fireworks material. And a hook hanging wall (91) is fixed in the middle of the top of the casing (8). The hook (9) is fixed to the top end of the hook hanging wall (91), and the waterfall machine can be suspended by the hook (9) so that the cold fireworks can be discharged downwardly as a low temperature spark waterfall. Such a low temperature may range from 50 to 120 degrees Fahrenheit, and "low temperature" is a term used relative to typical temperatures of combustion firework sparks.

The hook (9) is generally a hook-like structure with its bottom fixed to the hook hanging wall (91) while the bottom side is provided with a tension lever (92) which extends into the inside of the hook (9) with its end portion (95) for suspending the suspension and the hook portion of the hook (9) having two internal teeth (93) and (94), and the internal teeth (93) and (94) being arranged at 80 to 100° to clamp the suspension.

Figure 7:
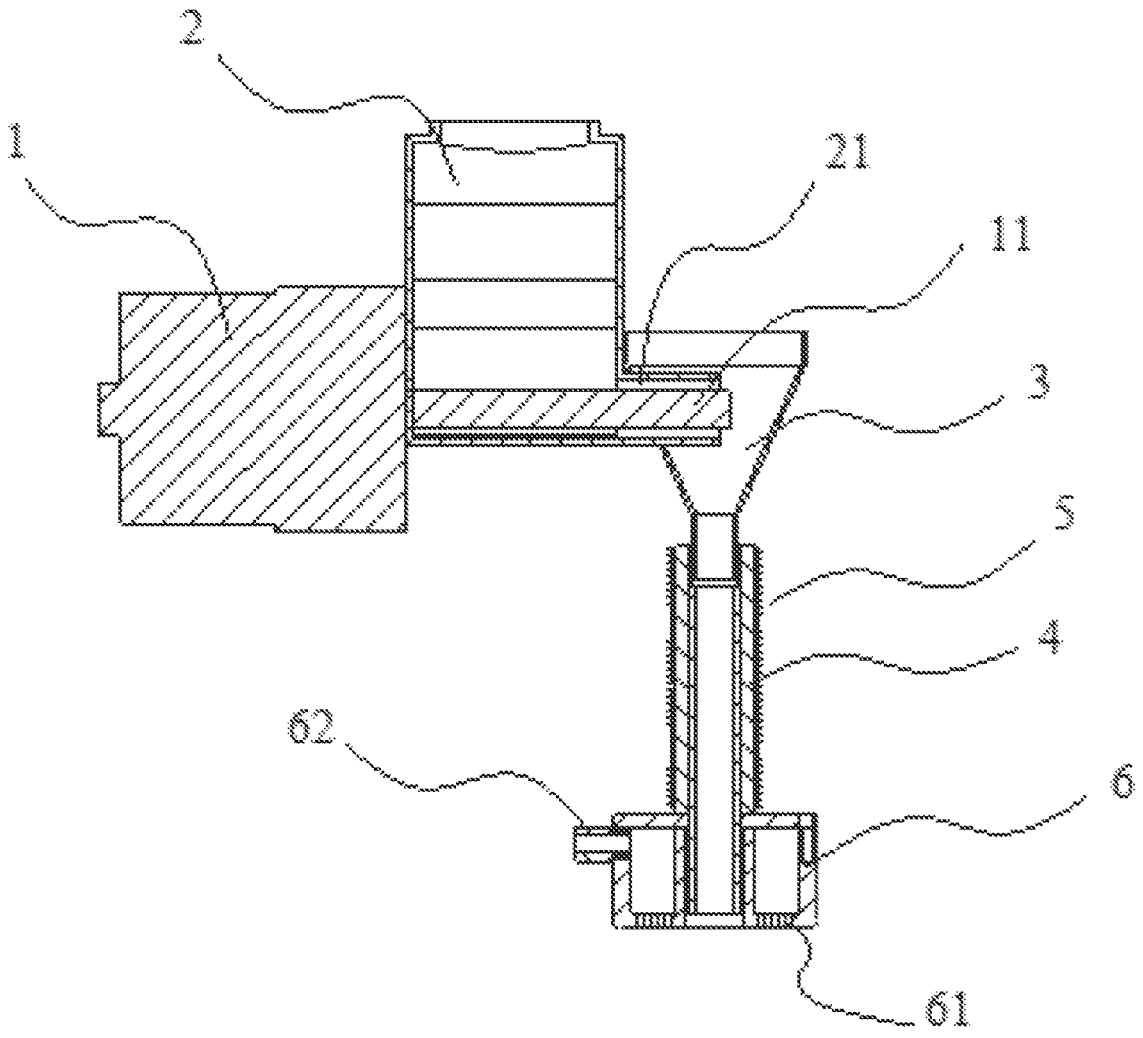
FIG. 7 is a schematic view of another embodiment of the present invention.
Figure 8:
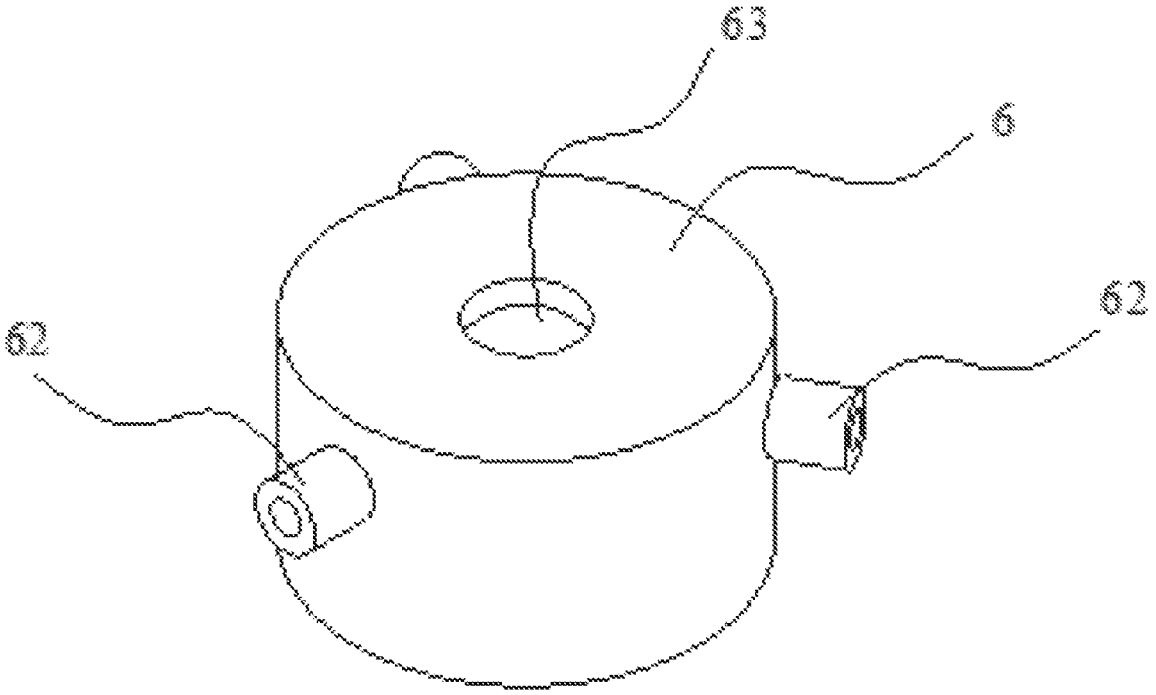
FIG. 8 is a perspective view of an accelerating unit according to another embodiment of the present invention.
Figure 9:
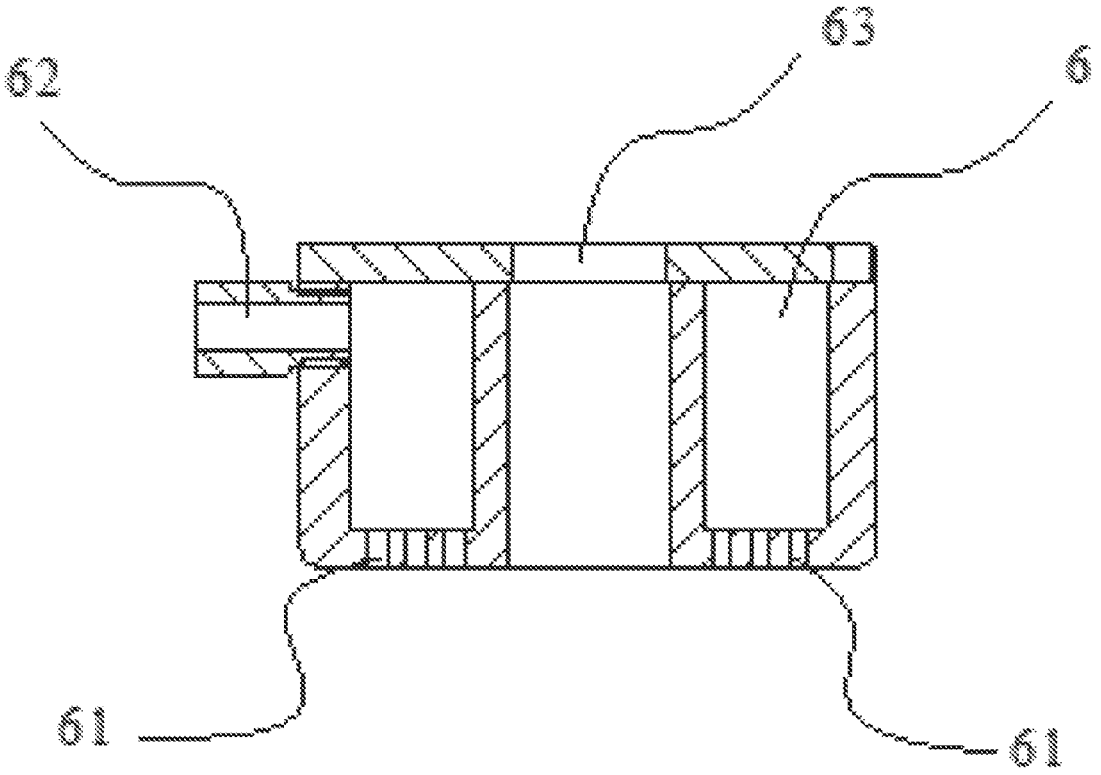
FIG. 9 is a cross-sectional view of the accelerating unit.

The present invention may also be implemented by other implementations, as shown in FIGS. 7, 8, and 9.

Figure 5:
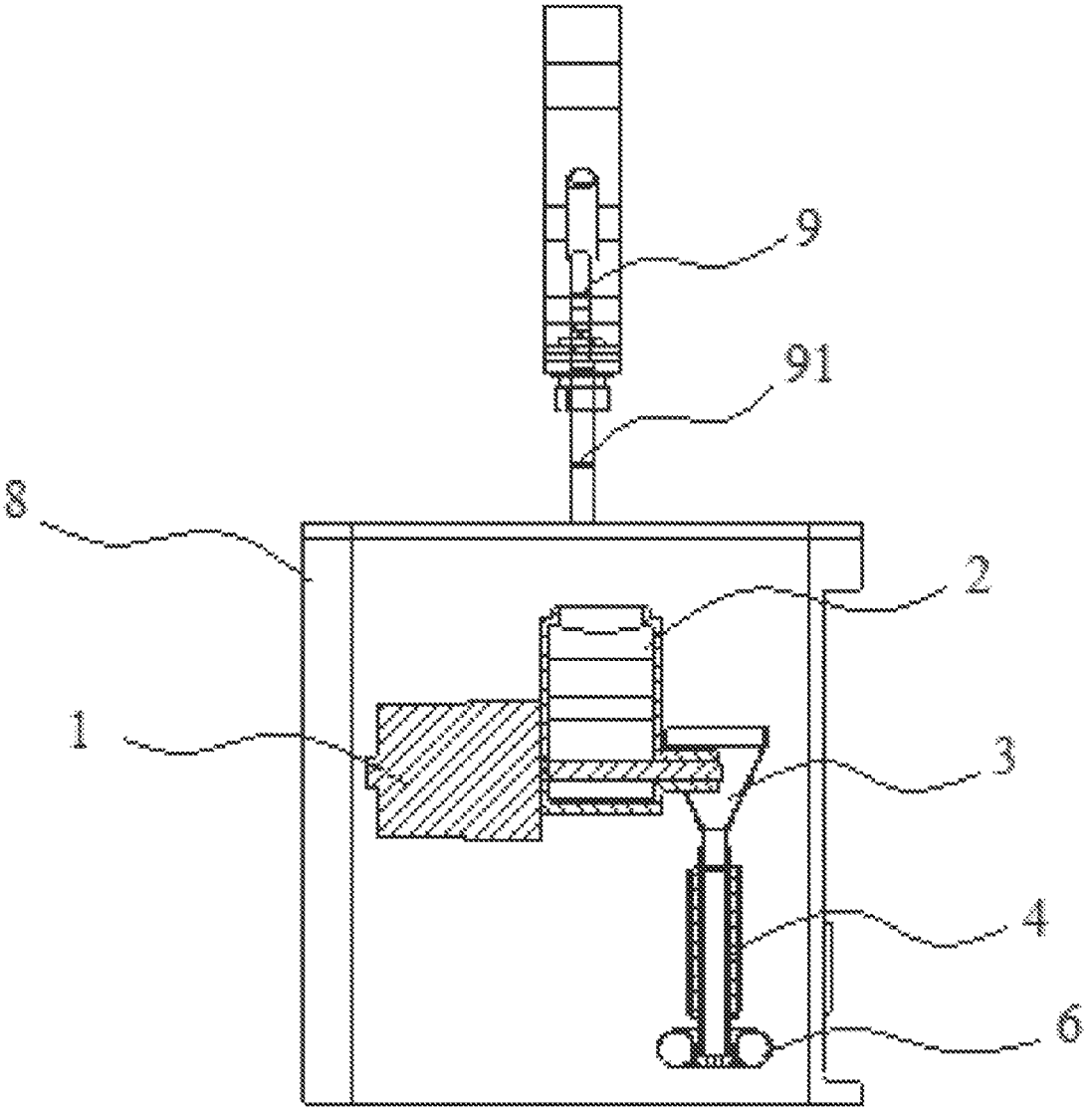
FIG. 5 is a cross-sectional view of the device of FIG. 4.
Figure 6:
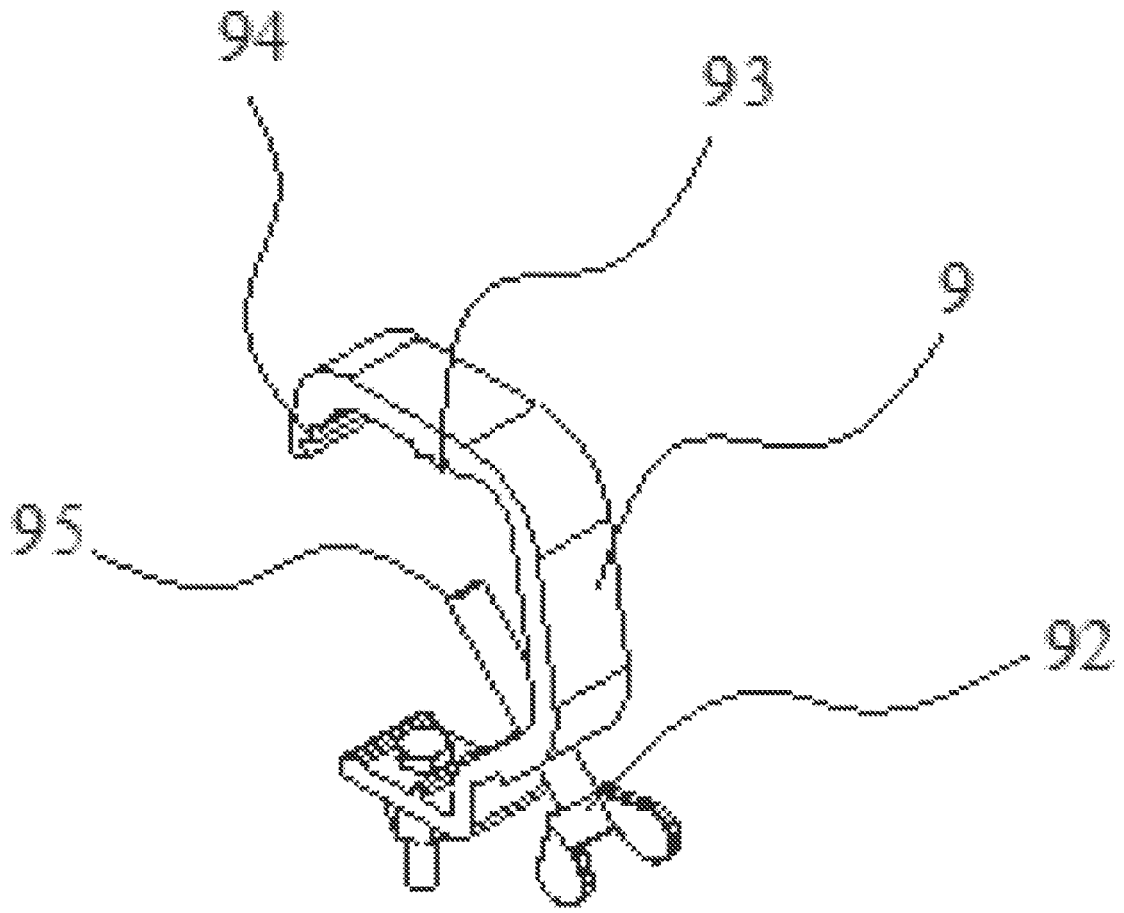
FIG. 6 is a perspective view showing the structure of the hook.

In the other implementations, the acceleration unit, the heating unit, the power unit and the storage unit are still included, wherein the power unit is utilized by the motor (1), and the storage unit is realized by the stocker (2). The hopper (2) is connected with a funnel (3). A heating tube (4) is connected to the bottom of the hopper (3), and the heating coil (6) is wound around the outer wall of the heating pipe (4), and the accelerating unit is fixed to the lower side of the heating pipe (4). As shown in FIG. 5 The structure of the motor (1), the hopper (2), the funnel (3), the heating pipe (4) and the heating coil (5) is the same as that shown in FIG. 1, except that the accelerating unit is different.

For the accelerating unit, there is still an air chamber (6) and a duct (62) and a fan in which the upper portion of the air chamber (6) has an engaging hole (63) whose inner diameter is equal to the outer diameter of the heating tube (4) so that the heating tube (4) can be inserted to the engagement hole (63) so as to be fixed.

The air chamber (6) is provided in a horizontal configuration and the upper periphery of the air chamber (6) is provided with 2 to 6 air ducts (62) which are provided horizontally and the air duct (62) is connected to the fan for blowing, thereby causing an acceleration action. A plurality of nozzles (61) is provided on the lower surface of the lower portion to eject the air flow to accelerate the spark.

In summary, the invention has the advantages of simple structure, simple realization, small volume and good handling performance by combining the simple accelerating unit, the storage unit, the heating unit and the like to realize the effect of the cold sparks falling down, appearing as a waterfall of sparks. The simple structure is easy to transport and install, and the use of the process will not take up too much space. The system is easy to set up, being easily hangable above a stage. The device can be suspended according to specific requirements any appropriate place.

The foregoing is merely illustrative of the preferred embodiments of the present invention and is not intended to limit the invention, and any modifications, equivalent substitutions and improvements within the spirit and principles of the invention are intended to be encompassed by the invention Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A machine for discharging a waterfall of low-temperature sparks, the machine comprising: an accelerating unit; a heating unit; a power unit; and a storage unit; the storage unit being configured to store a source material, the power unit being connected to the storage unit, the storage unit being connected with the heating unit; the power unit being configured to transmit the source material in the storage unit to the heating unit; the heating unit being configured to excite the source material, and send the source material to the acceleration unit; the acceleration unit being configured to cause excited source material to accelerate in a downward eruption to generate a waterfall of low temperature sparks; and wherein a heating tube of the heating unit is arranged vertically.

2. The machine of claim 1, wherein the machine is configured to be hung, and its components are positioned and configured to give the machine balance while the machine is hanging.

3. The machine of claim 1, wherein to balance the machine while it is hanging, the storage unit centered, and the power unit, the heating unit, the acceleration unit are arranged on opposite sides of the storage unit, to achieve a centrally located center or gravity.

4. The machine of claim 1, wherein the source material is configured to adopt an appearance of a spark by being subjected to airflow while the source material is in an excited state.

5. The machine of claim 1, wherein the power unit includes a pushing mechanism that extends into a hopper and is capable of projecting a portion of the source material from the storage unit to eject the source material from the storage unit.

6. The machine of claim 1, wherein the heating unit includes a heating tube and a heating coil.

7. The machine of claim 1, wherein the power unit is connected to an output shaft of a motor and is arranged horizontally, and the power unit is provided at a bottom of a hopper so as to be able to push the source material out of the storage unit.

8. The machine of claim 1, wherein the storage bin is provided with a pushing mechanism mounting port corresponding to a horizontal position of a pushing mechanism of the power unit, and the pushing mechanism mounting port and the pushing mechanism are sealed to avoid leakage of the source material.

9. The machine of claim 1, wherein the pushing mechanism includes a threaded structure that pushes the source material via the threads in response to the threaded structure being rotated by the power unit.

10. The machine of claim 1, wherein a connecting portion of the storage unit and the heating unit is provided with a funnel which is connected to a heating pipe so as to transfer the source material into the heating unit for being excited.

11. The machine of claim 1, wherein the accelerating unit includes a fan, and the machine includes an air chamber connected to the heating unit, where a lower part of the air chamber is provided with one or more ducts that receive air forced by the fan to accelerate excited material downward and spray excited material from a nozzle downwardly to achieve the effect of a low-temperature spark discharge downwardly.

12. A machine for discharging a waterfall of low-temperature sparks, the machine comprising: an accelerating unit; a heating unit; a power unit; and a storage unit; the storage unit being configured to store a source material, the power unit being connected to the storage unit, the storage unit being connected with the heating unit; the power unit being configured to transmit the source material in the storage unit to the heating unit; the heating unit being configured to excite the source material, and send the source material to the acceleration unit; the acceleration unit being configured to cause excited source material to accelerate in a downward eruption to generate a waterfall of low temperature sparks; wherein the machine is configured to be hung, and its components are positioned and configured to give the machine balance while the machine is hanging; wherein to balance the machine while it is hanging, the storage unit centered, and the power unit, the heating unit, the acceleration unit are arranged on opposite sides of the storage unit, to achieve a centrally located center or gravity; wherein the source material is configured to adopt an appearance of a spark by being subjected to airflow while the source material is in an excited state; wherein the power unit includes a pushing mechanism that extends into a hopper and is capable of projecting a portion of the source material from the storage unit to eject the source material from the storage unit; wherein the heating unit includes a heating tube a heating coil; and wherein the heating tube of the heating unit is arranged vertically.

13. The machine of claim 12, wherein the power unit is connected to an output shaft of a motor and is arranged horizontally, and the power unit is provided at a bottom of a hopper so as to be able to push the source material out of the storage unit.

14. The machine of claim 12, wherein the storage bin is provided with a pushing mechanism mounting port corresponding to a horizontal position of a pushing mechanism of the power unit, and the pushing mechanism mounting port and the pushing mechanism are sealed to avoid leakage of the source material.

15. The machine of claim 12, wherein the pushing mechanism includes a threaded structure that pushes the source material via the threads in response to the threaded structure being rotated by the power unit.

16. The machine of claim 12, wherein a connecting portion of the storage unit and the heating unit is provided with a funnel which is connected to a heating pipe so as to transfer the source material into the heating unit for being excited.

17. The machine of claim 12, wherein the accelerating unit includes a fan, and the machine includes an air chamber connected to the heating unit, where a lower part of the air chamber is provided with one or more ducts that receive air forced by the fan to accelerate excited material downward and spray excited material from a nozzle downwardly to achieve the effect of a low-temperature spark discharge downwardly.

18. A machine for discharging a waterfall of low-temperature sparks, the machine comprising:

an accelerating unit;

a heating unit;

a power unit; and a storage unit;

the storage unit being configured to store a source material, the power unit being connected to the storage unit, the storage unit being connected with the heating unit;

the power unit being configured to transmit the source material in the storage unit to the heating unit;

the heating unit being configured to excite the source material, and send the source material to the acceleration unit;

the acceleration unit being configured to cause excited source material to accelerate in a downward eruption to generate a waterfall of low temperature sparks;

wherein the machine is configured to be hung, and its components are positioned and configured to give the machine balance while the machine is hanging;

wherein to balance the machine while it is hanging, the storage unit centered, and the power unit, the heating unit, the acceleration unit are arranged on opposite sides of the storage unit, to achieve a centrally located center or gravity;

wherein the source material is configured to adopt an appearance of a spark by being subjected to airflow while the source material is in an excited state;

wherein the power unit includes a pushing mechanism that extends into a hopper and is capable of projecting a portion of the source material from the storage unit to eject the source material from the storage unit;

wherein the heating unit includes a heating tube and a heating coil;

wherein the power unit is connected to an output shaft of a motor and is arranged horizontally, and the power unit is provided at a bottom of a hopper so as to be able to push the source material out of the storage unit;

wherein the storage unit is provided with a pushing mechanism mounting port corresponding to a horizontal position of the pushing mechanism of the power unit, and the pushing mechanism mounting port and the pushing mechanism are sealed to avoid leakage of the source material;

wherein the pushing mechanism includes a threaded structure that pushes the source material via the threads in response to the threaded structure being rotated by the power unit;

wherein a connecting portion of the storage unit and the heating unit is provided with a funnel which is connected to a heating pipe so as to transfer the source material into the heating unit for being excited;

wherein the heating tube of the heating unit is arranged vertically; and wherein the accelerating unit includes a fan, and the machine includes an air chamber connected to the heating unit, where a lower part of the air chamber is provided with one or more ducts that receive air forced by the fan to accelerate excited material downward and spray excited material from a nozzle downwardly to achieve the effect of a low-temperature spark discharge downwardly.

* * * * *